US009819110B2

(12) United States Patent
Castonguay

(10) Patent No.: US 9,819,110 B2
(45) Date of Patent: Nov. 14, 2017

(54) SEPARABLE CLASP CONNECTORS AND DIE SETS AND METHODS FOR LOCKING AND UNLOCKING SUCH CONNECTORS

(71) Applicant: Hubbell Incorporated, Shelton, CT (US)

(72) Inventor: Kevin Normand Castonguay, Weare, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/147,876

(22) Filed: May 5, 2016

(65) Prior Publication Data

US 2016/0329650 A1 Nov. 10, 2016

Related U.S. Application Data

(60) Provisional application No. 62/156,946, filed on May 5, 2015.

(51) Int. Cl.

| | |
|---|---|
| ***H01R 13/28*** | (2006.01) |
| ***H01R 43/26*** | (2006.01) |
| ***H01R 13/20*** | (2006.01) |
| *H01R 101/00* | (2006.01) |

(52) U.S. Cl.

CPC ..... *H01R 13/28* (2013.01); *H01R 13/20* (2013.01); *H01R 43/26* (2013.01); *H01R 2101/00* (2013.01)

(58) Field of Classification Search

CPC ..... H01R 13/213; H01R 13/28

USPC ..... 439/2, 288, 286, 287

See application file for complete search history.

(56) References Cited

U.S. PATENT DOCUMENTS

| | | | | |
|---|---|---|---|---|
| 534,732 A | | 2/1895 | Titcomb | |
| 1,689,824 A | | 10/1928 | Goelz | |
| 2,288,192 A | | 6/1942 | Hegenaur | |
| 2,478,143 A | * | 8/1949 | Watts | H01R 13/28 403/393 |
| 2,626,168 A | * | 1/1953 | Macy | H01R 13/28 439/288 |
| 2,636,071 A | | 4/1953 | Matthysse | |
| 2,738,477 A | * | 3/1956 | Matthysse | H01R 13/28 24/583.11 |
| 2,977,567 A | | 3/1961 | Matthysse | |
| 4,289,366 A | * | 9/1981 | Marks | H01R 23/27 439/287 |
| 4,626,126 A | | 12/1986 | Suchdev et al. | |

(Continued)

OTHER PUBLICATIONS

International Search Report dated Aug. 12, 2016 from corresponding International PCT Application No. PCT/US16/31072; 4 pages.

(Continued)

*Primary Examiner* — Phuong Dinh

(74) *Attorney, Agent, or Firm* — Ohlandt, Greeley, Ruggiero & Perle, L.L.P.

(57) ABSTRACT

A separable clasp connector is provided that has first and second parts that are pivotable with respect to one another by a die set. The clasp connector includes one or more die alignment features to ensure proper alignment with the die set so as to apply an unlocking force in a predetermined direction. Die sets and methods also provided to move a separable clasp connector back-and-forth among a locked position and an unlocked position.

11 Claims, 16 Drawing Sheets

(56) References Cited

U.S. PATENT DOCUMENTS

| | | | | |
|---|---|---|---|---|
| 5,834,696 | A * | 11/1998 | Kurosawa | H01R 13/213 174/84 C |
| 6,186,821 | B1 | 2/2001 | Mullen, Jr. | |
| 9,039,435 | B2 * | 5/2015 | Horiuchi | H01R 4/64 439/287 |

OTHER PUBLICATIONS

Written Opinion dated Aug. 12, 2016 from corresponding International PCT Application No. PCT/US16/31072; 9 pages.

* cited by examiner

SEPARABLE CLASP CONNECTORS AND DIE SETS AND METHODS FOR LOCKING AND UNLOCKING SUCH CONNECTORS

CROSS REFERENCE TO RELATED APPLICATIONS

This application claims the benefit of U.S. Provisional Application Ser. No. 62/156,946 filed on May 5, 2015, the entire contents of which are incorporated herein by reference.

BACKGROUND

1. Field of the Disclosure

The present disclosure is related to separable clasp connectors. More particularly, the present disclosure is related to separable clasp connectors, as well as die sets and methods for locking and unlocking such connectors.

2. Description of Related Art

Various types of electrical connectors for connecting two conductors to one another are known. One type of such electrical connectors is commonly known as a separable clasp connector. Examples of such separable clasp connectors are described in Applicant's own U.S. Pat. No. 2,288,192; U.S. Pat. Nos. 2,636,071; and 2,977,567.

Generally, separable clasp connectors include a first part connectable to one conductor and a second part connectable to a second conductor. The first and second parts include one or more cooperative features (e.g., slots, pins, blades, etc.). The cooperative features allow the two parts to be initially coupled to one another in an angled position—where the parts are not mechanically locked to one another. The cooperative features also allow the two parts to be rotated into an in-line position whereby the parts are both mechanically and electrically interlocked to one another.

During movement from the unlocked position to the locked position, one or more portions of the first and/or second part are deformed—with the deformation providing a holding force that maintains the parts in the locked position. Conversely, movement to the unlocked position allows the deformed portions of the first and/or second part to return to their normal state—allowing the parts to be separated from one another.

It has been determined by the disclosure that it can be difficult to apply the necessary force to move prior art clasp connectors back-and-forth among the angled position (e.g., unlocked) and the inline position (e.g., locked) and/or that the application of such force can result in damage to one or more portions of the connectors.

Accordingly, there is a need for separable clasp connectors, die sets, and methods of locking and unlocking such connectors that overcome, alleviate, and/or mitigate one or more of the aforementioned and other deleterious effects of prior art connectors.

SUMMARY

A separable clasp connector is provided that has first and second parts that are pivotable with respect to one another by a die set. The clasp connector includes one or more die alignment features to ensure proper alignment with the die set so as to apply an unlocking force in a predetermined direction.

A locking die set and/or an unlocking die set are also provided to move a separable clasp connector back-and-forth among a locked position and an unlocked position.

A method of moving a clasp connector from one position to another position in a die press is provided.

A separable clasp connector is provided that includes a first part and a second part each having a connector body and a connector barrel. The connector barrels secure the first and second parts to different electrical conductors. The first and second parts have corresponding features that allow movement of the first and second parts with respect to one another among a separated position, an unlocked position, and a locked position. The first and second parts, when in the separated position, are not mechanically or electrically connected to one another. The first and second parts, when in the unlocked position, are not mechanically locked to one another. However, the first and second parts, when in the locked position, are mechanically and electrically connected to one another.

In some embodiments, the connector barrels can be crimped to the electrical conductors, respectively.

In other embodiments either alone or together with any of the aforementioned or after mentioned embodiments, the first and second parts are identical to one another.

In other embodiments either alone or together with any of the aforementioned or after mentioned embodiments, the corresponding features are selected from the group consisting of pins, cam slots, blades, blade slots, reliefs, chamfers, and any corresponding combinations thereof.

A separable clasp connector is also provided that includes a first part and a second part. The first part has a first connector body and a first connector barrel, while the second part has a second connector body and a second connector barrel. The first and second connector barrels are configured to secure the first and second parts to first and second electrical conductors, respectively. The first connector body has a first blade, a first blade slot, a first cam slot defined in the first blade, and a first pin in the first cam slot, the first pin extending above a mating surface of the first blade. Similarly, the second connector body has a second blade, a second blade slot, a second cam slot defined in the second blade, and a second pin in the second cam slot, the second pin extending above a mating surface of the second blade. The connector bodies are connectable to allow movement of the first and second parts with respect to one another among a separated position, an unlocked position, and a locked position. The first and second parts, when in the separated position, are not mechanically or electrically connected to one another. The first and second parts, when in the unlocked position, have the first pin received in the second cam slot and the second pin received in the first cam slot with the first and second parts angled with respect to one another such that the first and second parts are not mechanically locked to one another. The first and second parts, when in the locked position, have the first pin received in the second cam slot, the second pin received in the first cam slot, the first blade received in the second blade slot, and the second blade received in the second blade slot with the first and second parts being in-line with one another such that the first and second parts are mechanically and electrically connected to one another.

In some embodiments, the first and second parts are identical to one another.

In other embodiments either alone or together with any of the aforementioned or after mentioned embodiments, the first and second connector barrels are configured to be crimped to the first and second electrical conductors, respectively.

In other embodiments either alone or together with any of the aforementioned or after mentioned embodiments, the first and second connector barrels are brass.

In other embodiments either alone or together with any of the aforementioned or after mentioned embodiments, the first and second connector barrels are plated, at least in regions where the first and second connector barrels are intended to contact first and second electrical conductors, respectively, with an electrically conductive material.

In other embodiments either alone or together with any of the aforementioned or after mentioned embodiments, the first and second parts are copper.

In other embodiments either alone or together with any of the aforementioned or after mentioned embodiments, the first and second parts are plated, at least in regions where the first and second connector bodies contact one another, with an electrically conductive material.

In other embodiments either alone or together with any of the aforementioned or after mentioned embodiments, first blade slot has a width that is smaller than a width of the second blade and/or wherein the second blade slot has a width that is smaller than a width of the first blade such that movement from the unlocked position to the locked position resiliently deforms the first blade slot, the second blade slot, the first blade, the second blade, and any combinations thereof.

In other embodiments either alone or together with any of the aforementioned or after mentioned embodiments, the first and second blades further include a chamfer at a leading edge to assist in resiliently deforming the first and second blade slots, respectively.

In other embodiments either alone or together with any of the aforementioned or after mentioned embodiments, the first and/or second blade further includes a relief that can allow the first and/or second blades to resiliently deform when in the first and second blade slots, respectively.

In other embodiments either alone or together with any of the aforementioned or after mentioned embodiments, the first and second blades, the first and second blade slots, the first and second cam slots, and the first and second pins are configured so that the first and second parts can only be moved to the locked position in a single direction and can only be moved to the unlocked position opposite to the single direction.

A method for interlocking and separating separable clasp connector is provided. The method includes the steps of obtaining a first part and a second part each having a connector body and a connector barrel; interconnecting the connector bodies of the first and second parts without locking the first and second parts to one another; and pivoting the first and second parts with respect to one another in a first direction until the first and second parts are mechanically and electrically connected to one another.

In other embodiments either alone or together with any of the aforementioned or after mentioned embodiments, the method further includes the step of connecting the connector barrels to different electrical conductors.

In other embodiments either alone or together with any of the aforementioned or after mentioned embodiments, the step of pivoting in the first direction includes applying a locking force to the connector barrels of both the first and second parts and to the connector body of at least one of the first and second parts.

In other embodiments either alone or together with any of the aforementioned or after mentioned embodiments, the method further includes pivoting the first and second parts with respect to one another in a direction opposite the first direction until the first and second parts are can be separated from one another.

In other embodiments either alone or together with any of the aforementioned or after mentioned embodiments, the step of pivoting in the direction opposite to the first direction includes applying an unlocking force the connector body of at least one of the first and second parts and to the connector barrels of both the first and second parts.

In other embodiments either alone or together with any of the aforementioned or after mentioned embodiments, the step of obtaining the first and second parts includes obtaining two identical parts and wherein, prior to the interconnecting step, the two identical parts are rotated 180 degrees with respect to one another.

The above-described and other features and advantages of the present disclosure will be appreciated and understood by those skilled in the art from the following detailed description, drawings, and appended claims.

DETAILED DESCRIPTION

Figure 1:
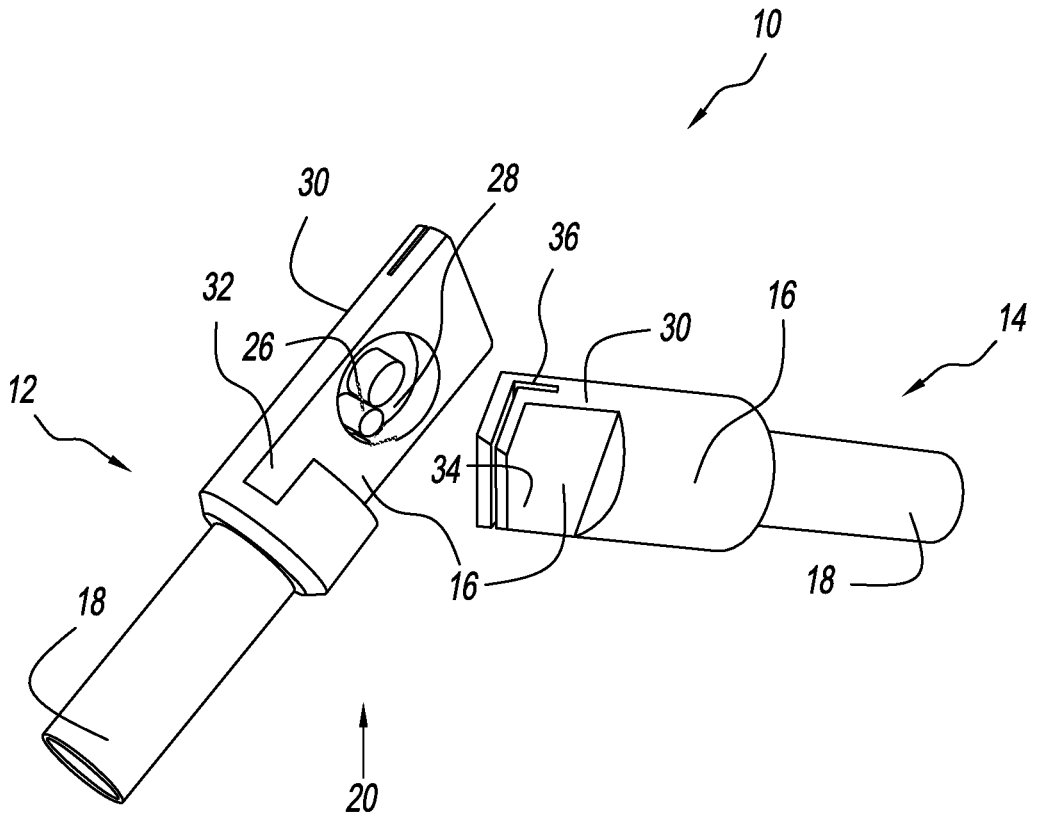
FIG. 1 is a first perspective view of an exemplary embodiment of a separable clasp connector according to the present disclosure shown in a separated position.
Figure 2:
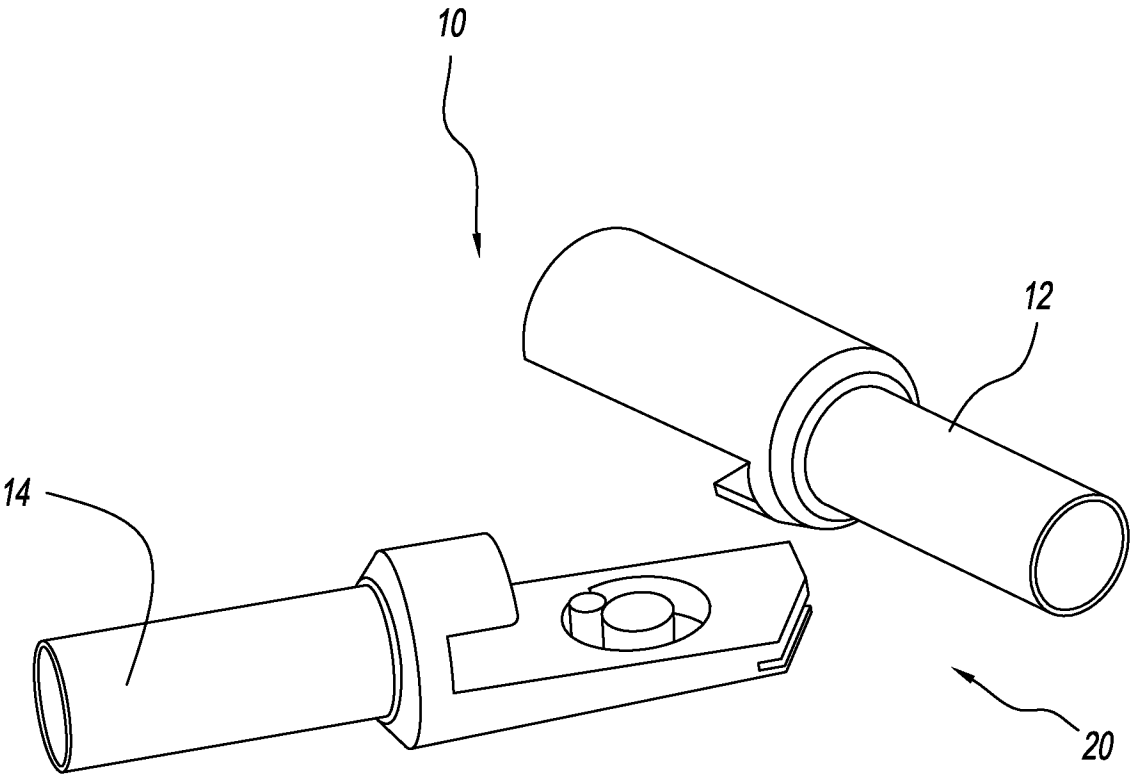
FIG. 2 is a second perspective view of the separable clasp connector of FIG. 1.
Figure 3:
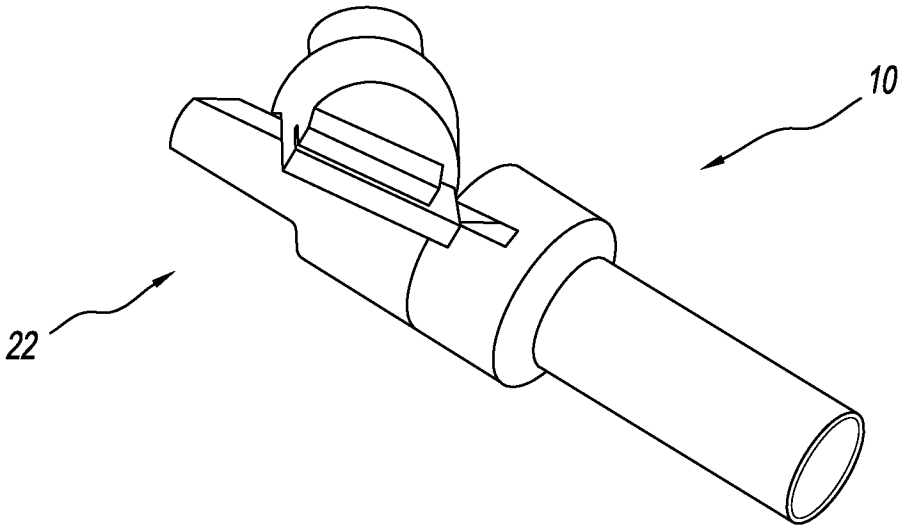
FIG. 3 is an end view of the separable clasp connector of FIG. 1 shown in an unlocked position.
Figure 4:
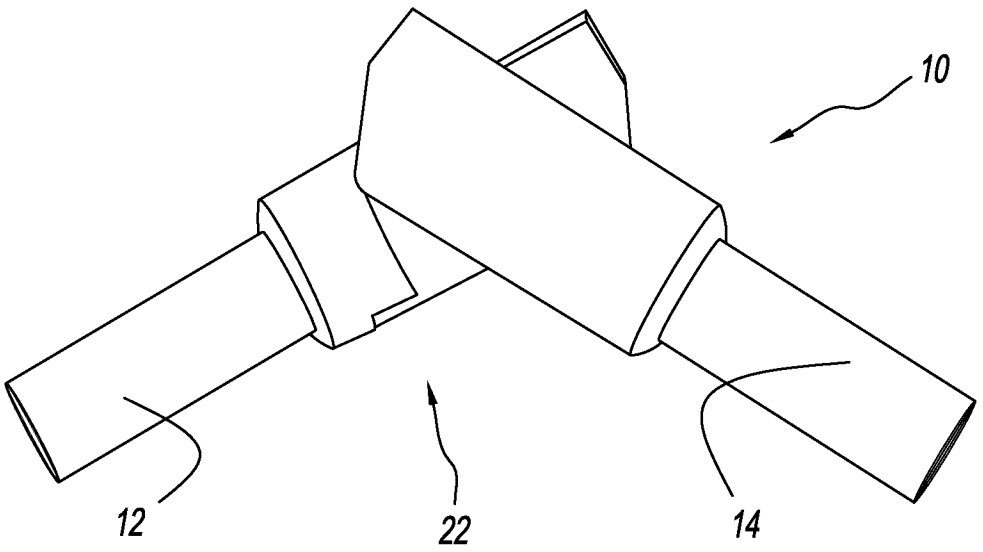
FIG. 4 is a first side view of the separable clasp connector of FIG. 3.
Figure 5:
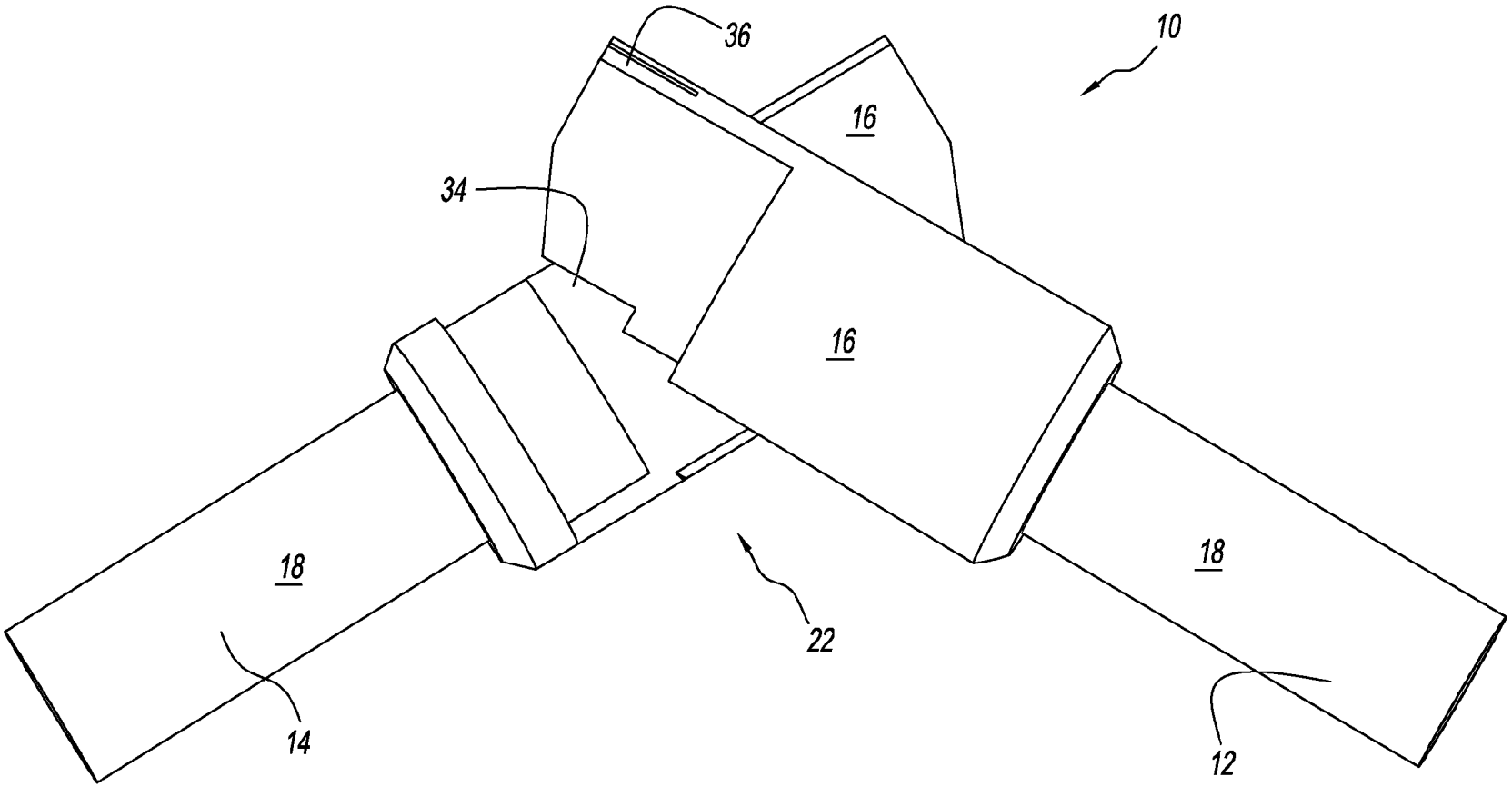
FIG. 5 is a second, opposite side view of the separable clasp connector of FIG. 3.

Referring to the drawings and in particular to FIGS. 1-12, an exemplary embodiment of a separable clasp connector according to the present disclosure is shown and is generally referred to by reference numeral 10. Advantageously, separable clasp connector 10 is configured for use with one or more die sets that allow the connector to be easily and reproducibly moved back-and-forth among locked and unlocked positions without damage to the connector.

Connector 10 includes a first part 12 and a second part 14 each having a connector body 16 and a connector barrel 18. For ease of description, parts 12, 14 are illustrated as being identical to one another. Of course, it is contemplated by the present disclosure for parts 12, 14 to be different from one another.

Figure 6:
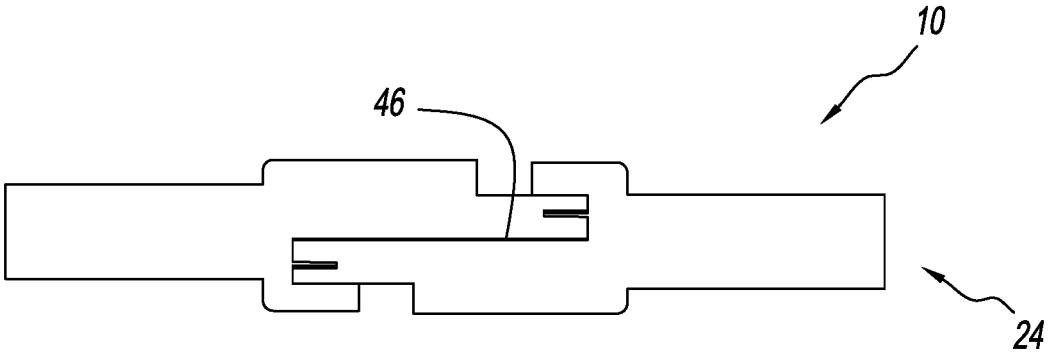
FIG. 6 is a top view of the separable clasp connector of FIG. 1 in a locked position.
Figure 7:
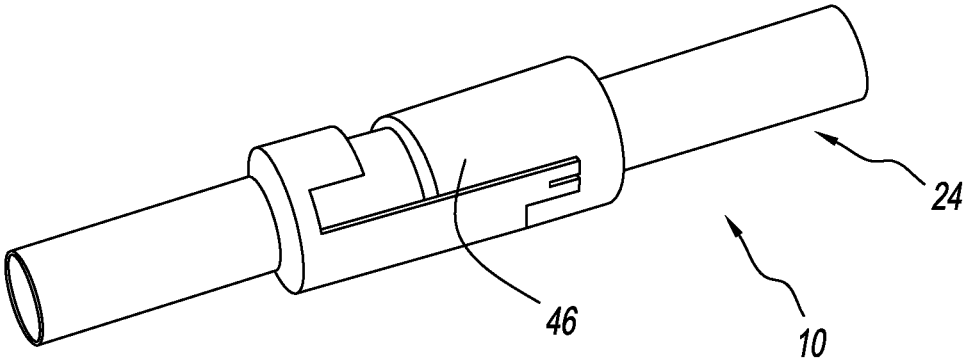
FIG. 7 is a perspective view of the separable clasp connector of FIG. 6.
Figure 8:
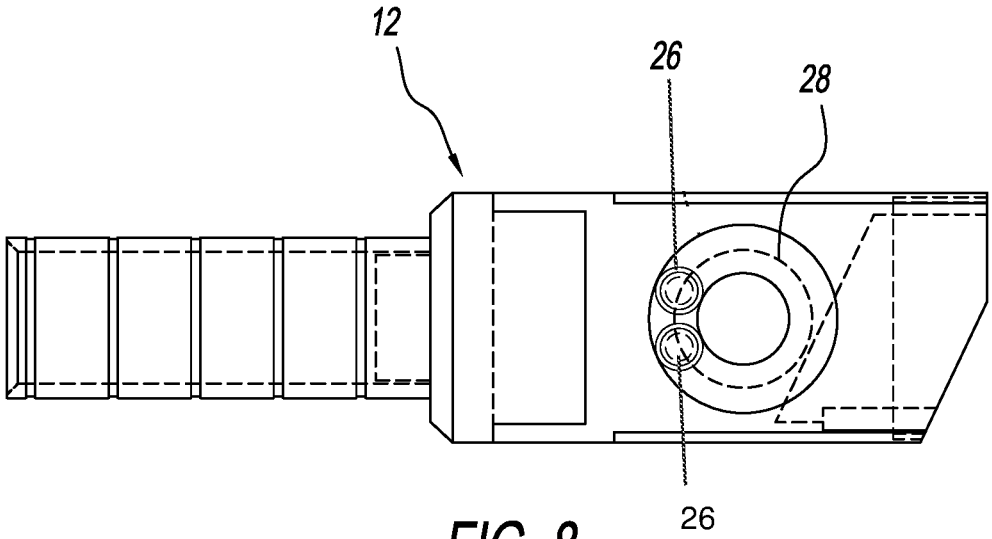
FIG. 8 is a side view of a first part of the separable clasp connector of FIG. 1.
Figure 9:
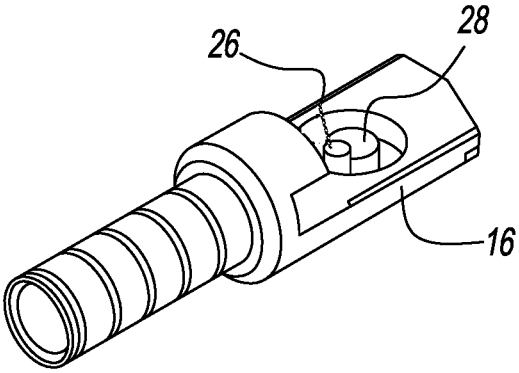
FIG. 9 is a perspective view of the first part of FIG. 8.
Figure 10:
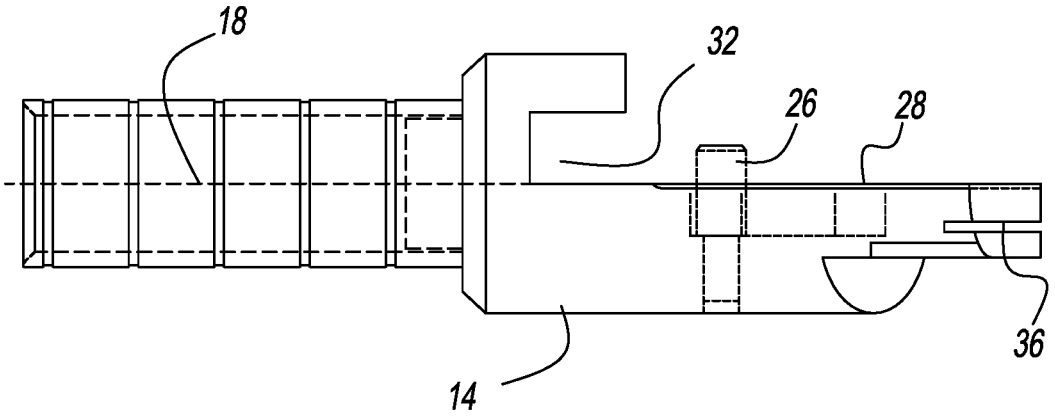
FIG. 10 is a side view of a second part of the separable clasp connector of FIG. 1.
Figure 11:
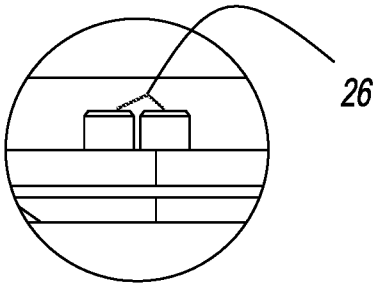
FIG. 11 is a magnified view of the pins of the second part of FIG. 10.
Figure 12:
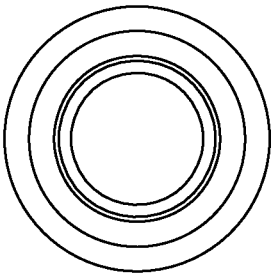
FIG. 12 is an end view of the first and second parts of FIGS. 8 and 10.

Bodies 16 are configured to allow first and second parts 12, 14 to have a separated position 20 as shown in FIG. 1, initially coupled to one another in an unlocked position 22 shown in FIGS. 2-5—where the parts are not mechanically locked to one another, and then rotated into a locked position 24 shown in FIGS. 6-7 whereby the parts 12, 14 are both mechanically and electrically connected to one another. Thus, connector 10 is described herein as being movable among separated position 20, unlocked position 22, and locked position 24.

Barrel 18 is configured to secure first and second parts 12, 14 to different electrical conductors (not shown). In some embodiments, barrel 18 can be crimped to the electrical conductor in a known manner. Of course, it is contemplated by the present disclosure for barrel 18 to be configured for connection to the electrical conductor in any desired manner.

Body 16 includes a set of pins 26 and cam slots 28 that allow the two parts 12, 14 to be initially coupled to one another from the separated position 20 to unlocked position 22. Additionally, pins 26 and cam slots 28 are configured to guide the two parts 12, 14 during rotation to/from unlocked and locked position 22, 24.

Body 16 includes a blade 30 and a blade slot 32 that are configured so that the blade of one part 12, 14 is received in the slot of the other part 12, 14 when the parts are in locked position 24—with the blade and slot acting to secure the parts in the locked position. For example, blade slot 32 can have a width that is smaller than the width of blade 30 received therein. In this manner, the movement of parts 12, 14 to locked position 24 requires blade 30 to deform blade slots 32 and/or to deform the blade itself—so that the blades from an interference or press fit connection with the blade slots when in the locked position.

In some embodiments, blade 30 includes a chamfer 34 at a leading edge to assist in deforming blade slot 32. In other embodiments alone or in combination with the aforementioned embodiments, blade 30 include reliefs 36 that can allow the blade to resiliently deform when forced into blade slot 32. The resilient deformation can apply a spring force to parts 12, 14 to assist maintaining the parts in locked position 24.

In embodiments where first and second parts 12, 14 are identical to one another, the parts in the separated position 20 of FIG. 1 are rotated 180 degrees from one another to allow pin 26, cam slot 28, blade 30, and blade slot 32 of one of the parts to mate with the pin, cam slot, blade, and blade slot of the other part.

Barrel 18 can be made of brass or any other sufficiently ductile material for crimping onto the electrical conductor. Preferably, barrel 18 is plated—at least in regions where the barrel contacts the electrical conductor, with an electrically conductive material such as, but not limited to, silver.

Body 16 can be made of copper or any other sufficiently ductile and strong material for receiving blades 30 in blade slots 32. Preferably, body 16 is plated—at least in regions where first and second parts 12, 14 contact one another with an electrically conductive material such as, but not limited to, silver.

Connector 10 is moved to locked position 24 from unlocked position 22 by applying a locking force $F_L$ in a first direction 38 and is moved to the unlocked position from the unlocked position by applying an unlocking force $F_U$ in a second direction 40. It should be recognized that first and second directions 38, 40 are illustrated as linear application of the forces $F_L$, $F_U$ on connector 10, which imparts the desired pivoting movement on first and second parts 12, 14 back-and-forth among unlocked and locked positions 22, 24.

Figure 20:
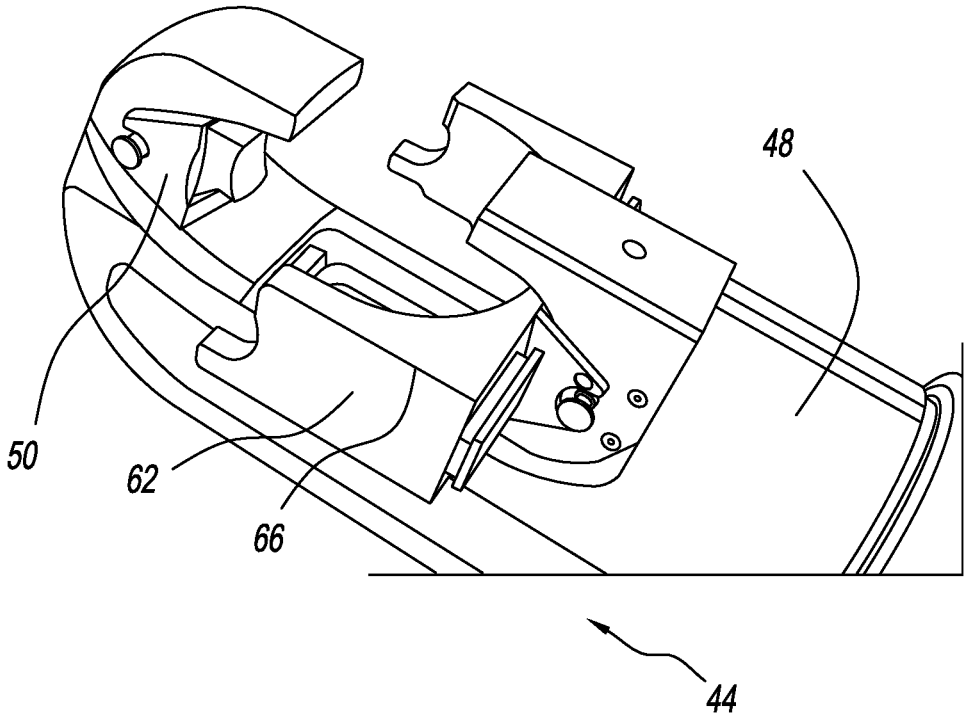
FIG. 20 is a perspective view of an exemplary embodiment of an unlocking die set according to the present disclosure before use.

As discussed briefly above and in more detail below, connector 10 is configured to be easily and reproducibly moved back-and-forth among unlocked and locked positions 22, 24 without damage by use with a locking die set 42 (FIG. 13) and/or an unlocking die set 44 (FIG. 20). Thus, connector 10 advantageously includes one or more die alignment features 46 to ensure that the operator properly aligns the connector with unlocking die set 44 so as to apply unlocking force $F_U$ in second direction 40.

Connector 10—due to the configuration of one or more of pins 26, cam slots 28, blade 30, and blade slot 32—is unidirectional, namely can only be moved from unlocked position 44 by application of the unlocking force $F_U$ in second direction 40 and can only be moved from locked position 24 by application of the locking force $F_L$ in first direction 38, otherwise damage to the connector can result.

However, it has been determined by the present disclosure that the operator cannot easily determine which direction to apply the unlocking force $F_U$ because connector 10, when in the locked position 24, has first and second parts 12, 14 in-line with one another. Stated another way, the in-line position of second parts 12, 14 with respect to one another when in locked position 24 makes it difficult for the operator to discern the proper orientation of connector 10 with respect to unlocking die set 44—a problem that is resolved by die alignment feature 46.

Of course and although connector 10, when in unlocked position 22, has first and second parts 12, 14 angled with respect to one another and therefore easier to discern the proper direction for application of the locking force $F_L$, it is further contemplated by the present disclosure for connector 10 to include one or more other die alignment features (not shown) to ensure that the operator properly aligns the connector with locking die set 42 so as to apply locking force $F_L$ in first direction 38.

Die alignment feature 46 can be any desired feature such as, but not limited to, an indentation, a protrusion, and any combinations thereof—which cooperate with corresponding features of the top and/or bottom die of the locking and/or unlocking die sets 42, 44, respectively.

It should be recognized that connector 10 is described above by way of example only as an exemplary embodiment having a particular configuration of body 16, barrel 18, pins 26, cam slots 28, blade 30, blade slot 32, chamfer 34, and reliefs 36. Of course, it is contemplated by the present disclosure for connector 10 to have any desired configuration capable of securing connector parts 12, 14 to different electrical conductors and being movable back-and-forth from the angled, unlocked position 22 and the inline, locked position 24—using die alignment feature 46.

Figure 18:
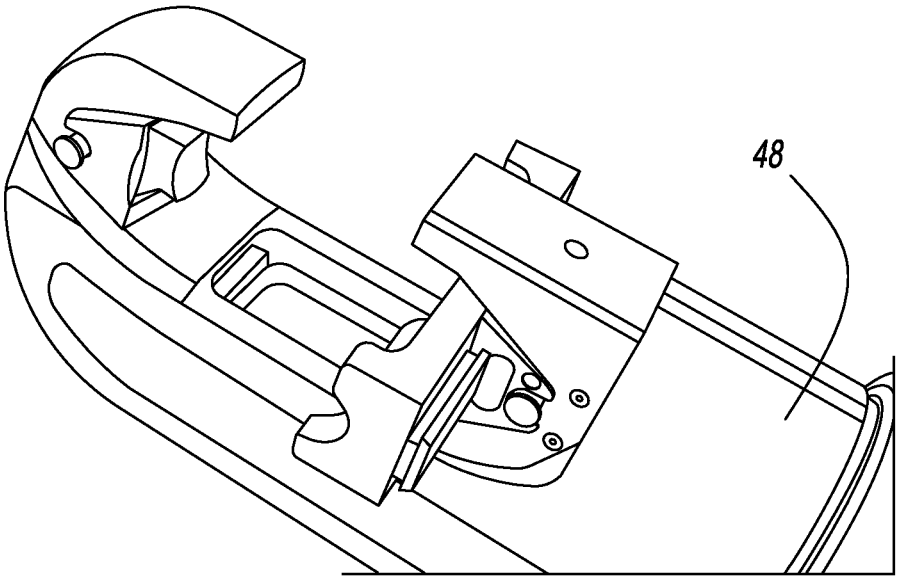
FIG. 18 is a perspective view of the locking die set of FIG. 13 after removal of the separable clasp connector.
Figure 19:
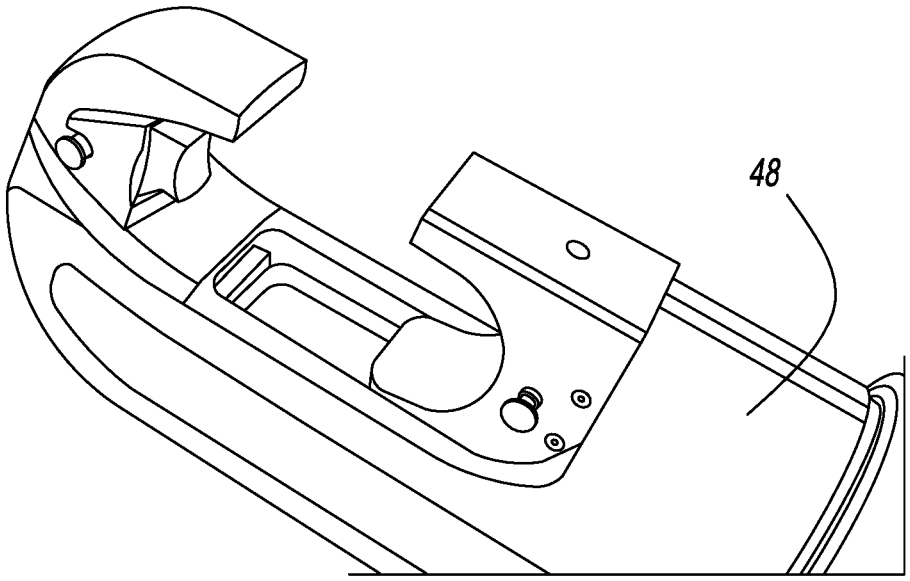
FIG. 19 is a perspective view during conversion from the locking die set of FIG. 13 to the unlocking die set of FIG. 20.

Locking die set 42 and methods of use are shown in FIGS. 13-18. Unlocking die set 44 and methods of use are shown in FIGS. 20-28. Conversion between locking and unlocking die sets 42, 44 is shown in FIGS. 18-20. Here, die sets 42, 44 are illustrated in use with a die press 48, which has C-shaped jaw. Die press 48 can be actuated by electrical assist, hydraulic assist, pneumatic assist, or any combinations thereof.

Thus, locking die set 42, in combination with die press 48, is configured to move connector 10 from unlocked position 22 to locked position 24, while unlocking die set 44, in combination with the die press, is configured to move the connector from the locked position to the unlocked position.

The locking of connector 10 is described with reference to FIGS. 13-18. Locking die set 42 includes a top die 50 and a first bottom die 52. Top die 50 has a contact region 54 and first bottom die 52 includes a pair of support arms 56.

Figure 13:
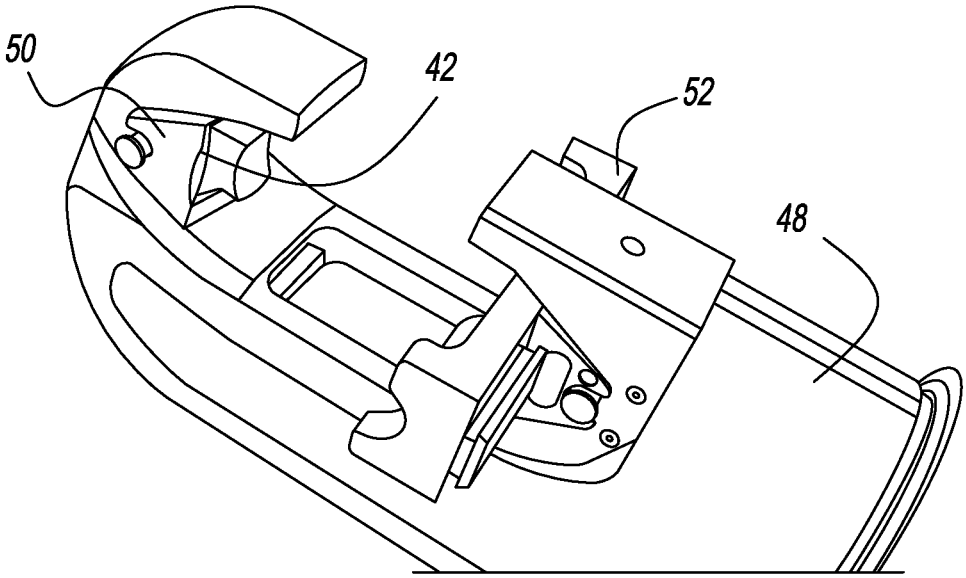
FIG. 13 is a perspective view of an exemplary embodiment of a locking die set according to the present disclosure before use.
Figure 14:
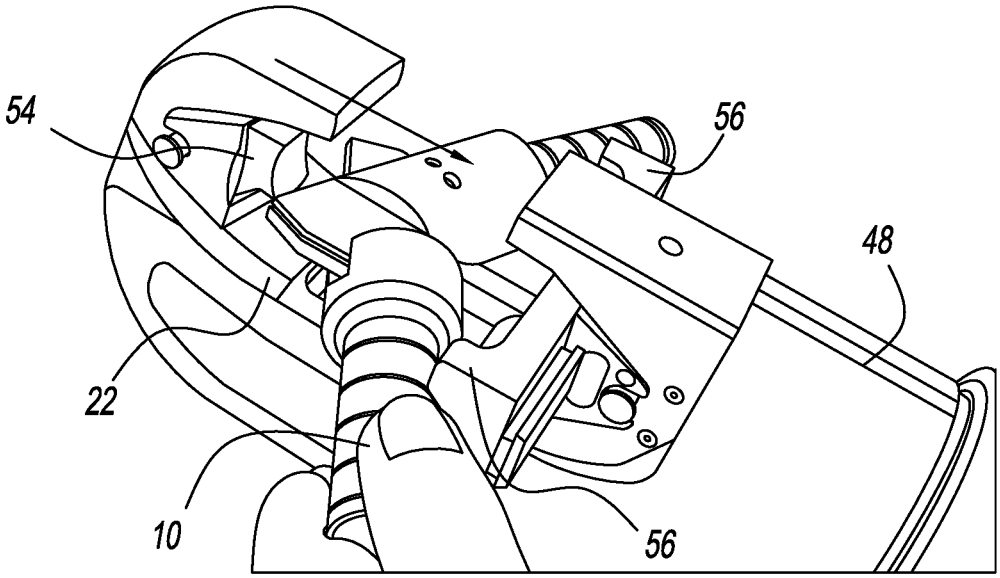
FIG. 14 is a perspective view of the locking die set of FIG. 13 having the separable clasp connector positioned therein in the angled or unlocked position.

Die press 48 is moved to the open position shown in FIG. 13 and top and bottom dies 50, 52 of locking die set 42 are installed in the die press. Connector 10, in unlocked position 22, is then placed on support arms 56 of first bottom die 52 as shown in FIG. 14 in an orientation such that contact region 54 of top die 50 can apply locking force $F_L$ to the connector in first direction 38.

Figure 15:
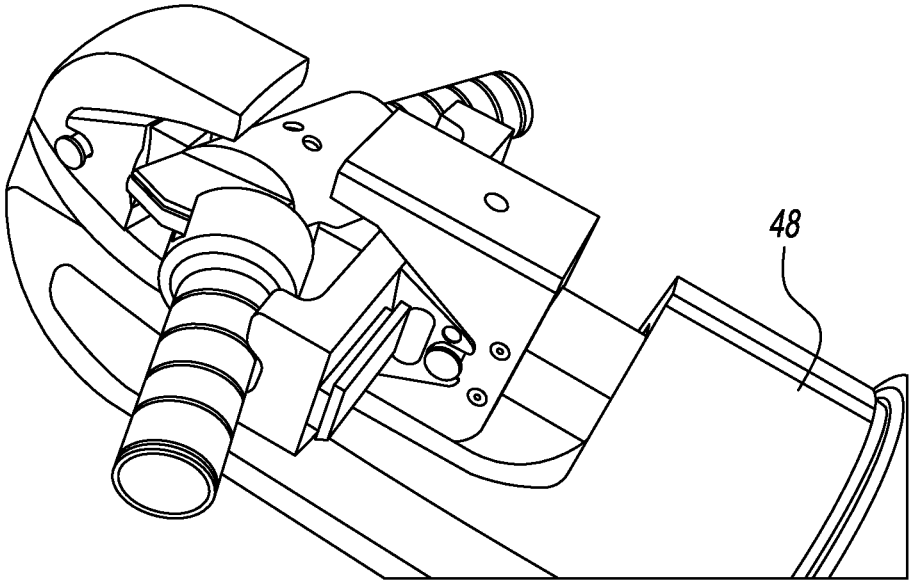
FIG. 15 is a perspective view of the locking die set of FIG. 13 after movement of the locking die set into contact with the separable clasp connector.
Figure 16:
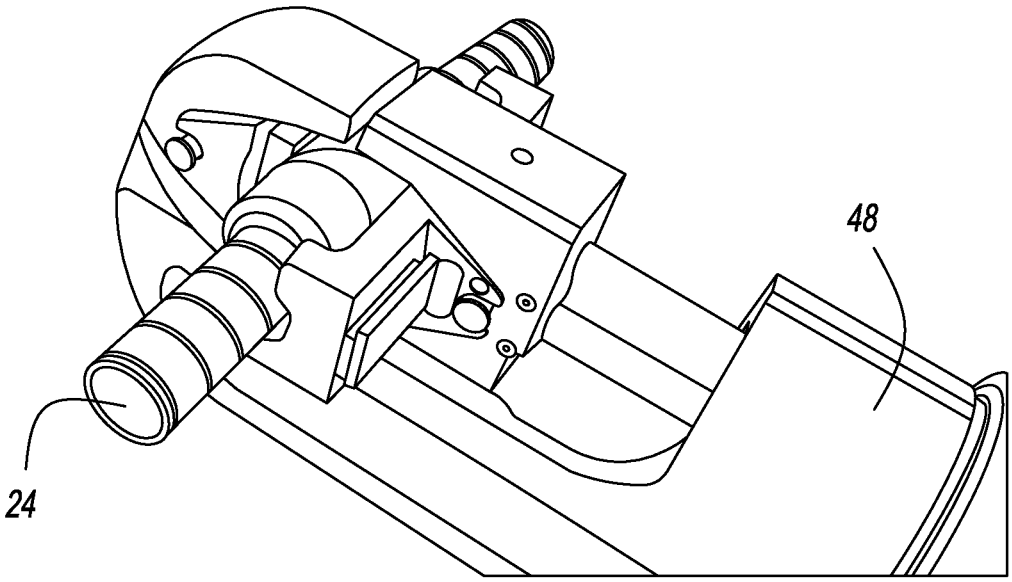
FIG. 16 is a perspective view of the locking die set of FIG. 13 after the locking die set has moved the separable clasp connector to the inline or locked position.
Figure 17:
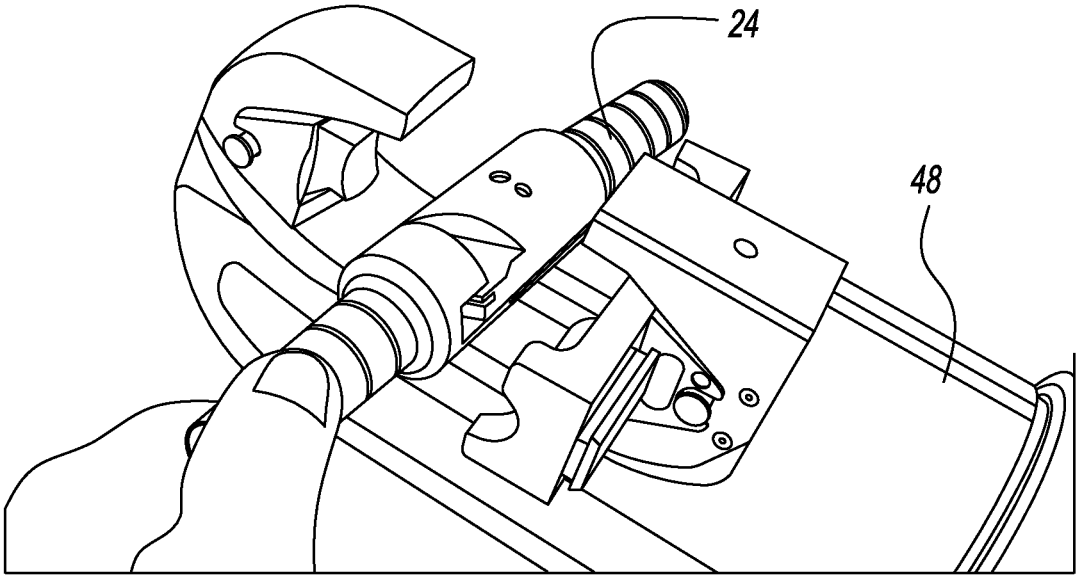
FIG. 17 is a perspective view of the locking die set of FIG. 13 after the locking die set has been moved out of contact with the separable clasp connector.

Die press 48 is then activated until contact region 54 of top die 50 contacts connector 10 and applies locking force $F_L$ to the connector in first direction 38 as shown in FIG. 15. Activation of die press 48 is continued until first and second parts 12, 14 move to locked position 24 as shown in FIG. 16. Die press 48 is then returned to the open position shown in FIG. 17 so that connector 10, in locked position 24, can be removed.

As discussed above, connector 10—due to the configuration of one or more of pins 26, cam slots 28, blade 30, and blade slot 32—is unidirectional. Additionally, connector 10 can also—due to the aforementioned configurations—be damaged if first and second parts 12, 14 are pivoted past unlocked position 22 and/or locked position 24. Thus, locking die set 42 and/or unlocking die set 44 can include one or more stops to prevent over pivoting of first and second parts 12, 14. For example, and with reference to locking die set 42 of FIG. 16, the die set can include a stop 58 that prevents die press 48 from over pivoting first and second parts 12, 14.

Stop 58 can be secured to die press 48, top die 50, first bottom die 52, second bottom die 62, and any combinations thereof. Advantageously, stop 58 can allow die press 48 to be a full cycle tool, in which the operator would not have to monitor and stop the press at a particular location to prevent over pivoting connector 10. Rather, stop 58 and die press 48 can be configured so that upon completion of moving connector to locked position 24 or unlocked position 22—the hydraulic pressure/force would "blow off" once the stop bottoms out the die press.

The conversion from locking die set 42 to unlocking die set 44 is described with reference to FIGS. 18-20.

Die press 48 is first moved to the open position shown in FIG. 18 so that first bottom die 52 is removed from the die press as shown in FIG. 19 and replaced with second bottom die 62 as shown in FIG. 20.

Second bottom die 62, like first bottom die 52 discussed above, includes pair of support arms 66. Here, support arms 66 are longer than support arms 56 to provide sufficient clearance in a space 68 between the arms to receive connector 10 when in unlocked position 22.

Of course, it is contemplated by the present disclosure for second bottom die 62 to be used during both the locking and unlocking of connector 10—provided that die press 48 has sufficient clearance to receive the connector in unlocked position 22 in the orientation shown in FIG. 14. Additionally, it is contemplated by the present disclosure for top die 50 of locking die set 42 to differ from the top die of unlocking die set 44. Simply stated, locking and unlocking die sets 42, 44 can have the same or different top dies and/or the same or different bottom dies as required by the size of connector 10, the clearance available from die press 48, and any other variable in the process.

The unlocking of connector 10 is described with reference to FIGS. 20-24. Again, unlocking die set 44 includes top die 50 and second bottom die 62.

Figure 21:
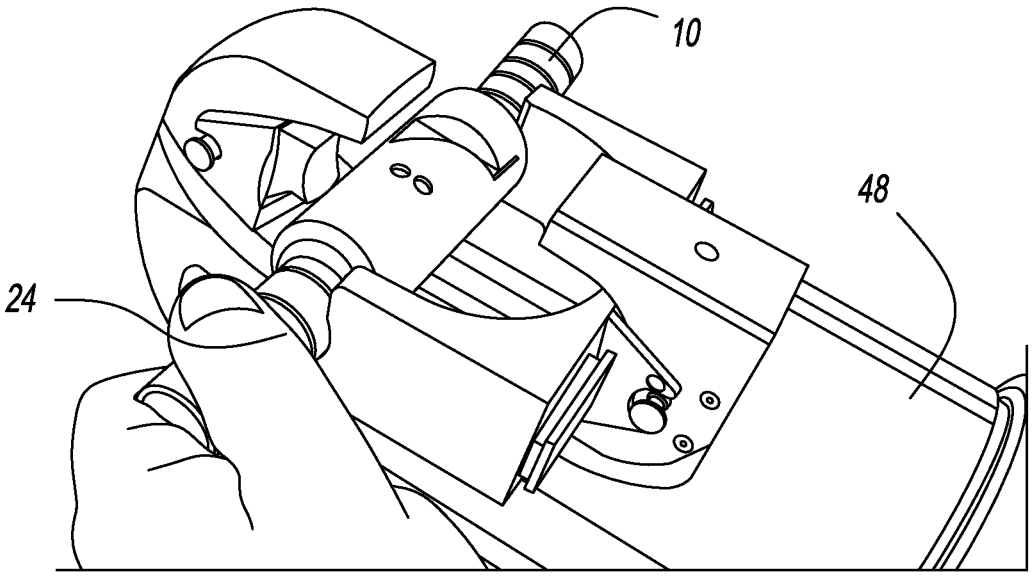
FIG. 21 is a perspective view of the unlocking die set of FIG. 20 having the separable clasp connector positioned therein in the inline or locked position.

Die press 48 is moved to the open position shown in FIG. 20 and top and bottom dies 50, 62 of unlocking die set 44 are installed in the die press. Connector 10, in locked position 24, is then placed on support arms 66 of second bottom die 62 as shown in FIG. 21 in an orientation such that contact region 54 of top die 50 can apply unlocking force $F_U$ to the connector in second direction 40.

Figure 22:
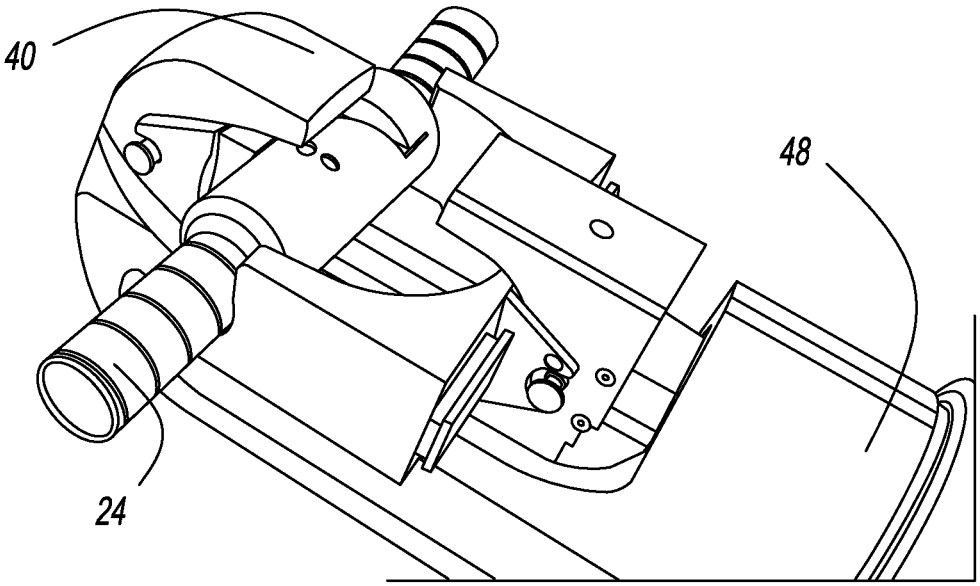
FIG. 22 is a perspective view of the unlocking die set of FIG. 20 after movement of the unlocking die set into contact with the separable clasp connector.
Figure 23:
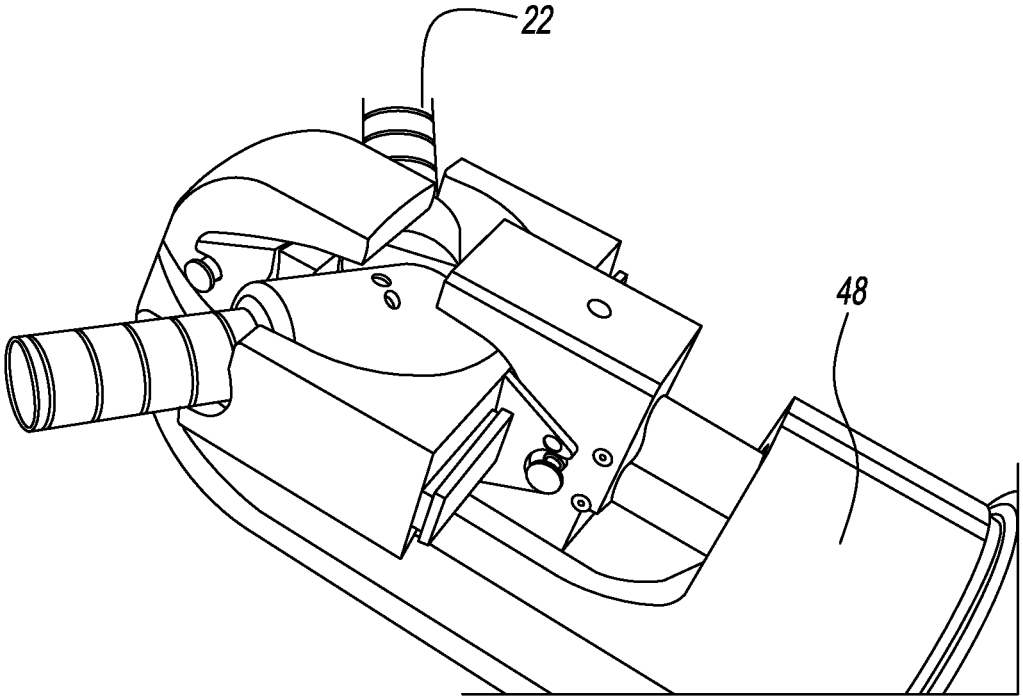
FIG. 23 is a perspective view of the unlocking die set of FIG. 20 after the unlocking die set has moved the separable clasp connector to the angled or unlocked position.
Figure 24:
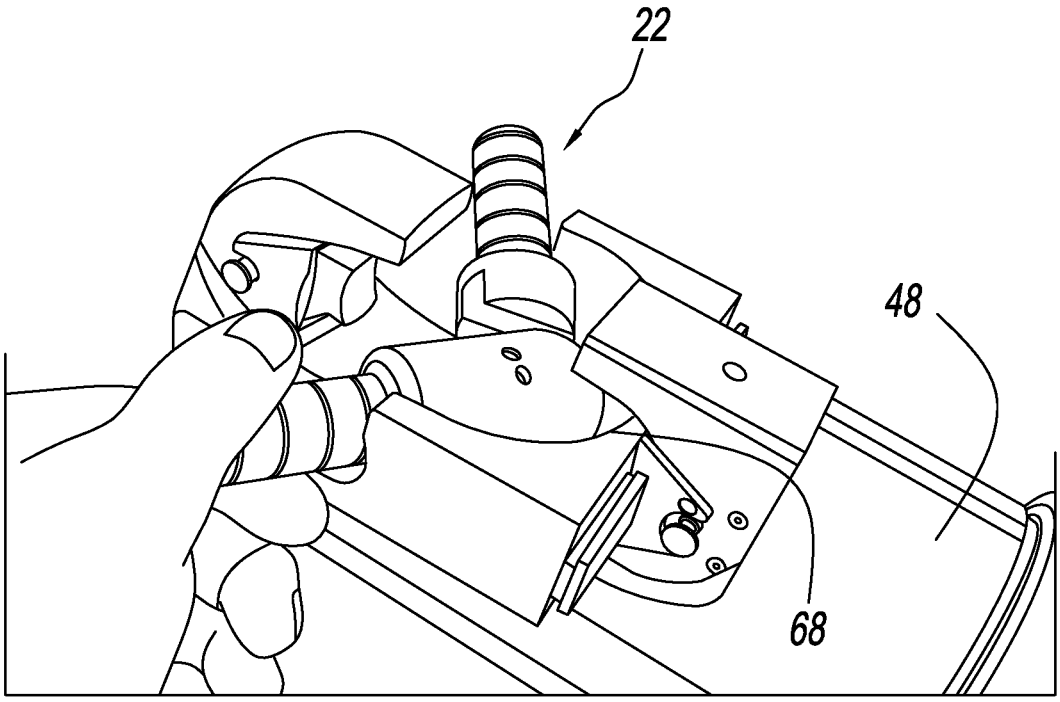
FIG. 24 is a perspective view of the unlocking die set of FIG. 20 after the unlocking die set has been moved out of contact with the separable clasp connector.
Figure 25:
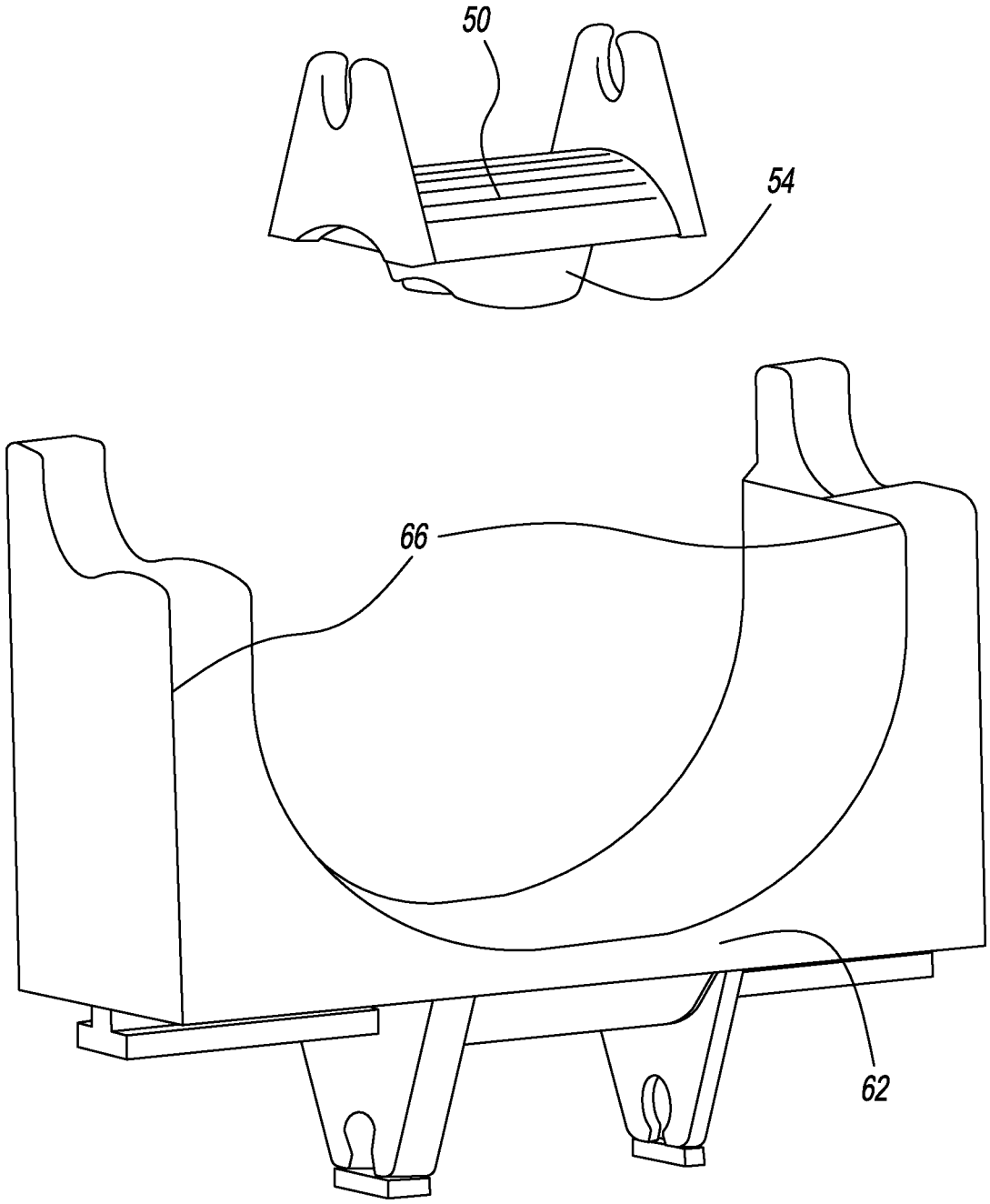
FIG. 25 is a first perspective view of the unlocking die set of FIG. 20.

Die press 48 is then activated until contact region 54 of top die 50 contacts connector 10 and applies unlocking force $F_U$ to the connector in second direction 40 as shown in FIG. 22. Activation of die press 48 is continued until first and second parts 12, 14 move to unlocked position 22 as shown in FIG. 23. Die press 48 is then returned to the open position shown in FIG. 24 so that connector 10, in unlocked position 22, can be removed. Various details of unlocking die set 44 can be seen in FIG. 25.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

REFERENCE NUMERALS separable clasp connector 10
first part 12 second part 14
connector body 16
connector barrel 18
separated position 20
unlocked position 22
locked position 24
pins 26 space 68
cam slots 28
blade 30
blade slot 32
chamfer 34
reliefs 36
locking force $F_L$
first direction 38
second direction 40
locking die set 42
unlocking die set 44
die alignment features 46
die press 48
top die 50
first bottom die 52
contact region 54
support arms 56
stop 58
second bottom die 62
pair of support arms 66
space 68

What is claimed is:

1. A separable clasp connector, comprising:

a first part having a first connector body and a first connector barrel, the first connector barrel being configured to secure the first part to a first electrical conductor; and a second part having a second connector body and a second connector barrel, the second connector barrel being configured to secure the second part to a second electrical conductor, the first connector body having a first blade, a first blade slot, a first cam slot defined in the first blade, and a first pin in the first cam slot, the first pin extending above a mating surface of the first blade the second connector body having a second blade, a second blade slot, a second cam slot defined in the second blade, and a second pin in the second cam slot, the second pin extending above a mating surface of the second blade, the first and second connector bodies being connectable to allow movement of the first and second parts with respect to one another among a separated position, an unlocked position, and a locked position, wherein, when in the separated position, the first and second parts are not mechanically or electrically connected to one another, wherein, when in the unlocked position, the first pin is received in the second cam slot and the second pin is received in the first cam slot with the first and second parts angled with respect to one another such that the first and second parts are not mechanically locked to one another, and wherein, when in the locked position, the first pin is received in the second cam slot, the second pin is received in the first cam slot, the first blade is received in the second blade slot, and the second blade is received in the second blade slot with the first and second parts being in-line with one another such that the first and second parts are mechanically and electrically connected to one another.

2. The separable clasp connector of claim 1, wherein the first and second parts are identical to one another.

3. The separable clasp connector of claim 1, wherein the first and second connector barrels are configured to be crimped to the first and second electrical conductors, respectively.

4. The separable clasp connector of claim 1, wherein the first and second connector barrels are brass.

5. The separable clasp connector of claim 4, wherein the first and second connector barrels are plated, at least in regions where the first and second connector barrels are intended to contact first and second electrical conductors, respectively, with an electrically conductive material.

6. The separable clasp connector of claim 1, wherein the first and second parts are copper.

7. The separable clasp connector of claim 6, wherein the first and second parts are plated, at least in regions where the first and second connector bodies contact one another, with an electrically conductive material.

8. The separable clasp connector of claim 1, wherein the first blade slot has a width that is smaller than a width of the second blade and/or wherein the second blade slot has a width that is smaller than a width of the first blade such that movement from the unlocked position to the locked position resiliently deforms the first blade slot, the second blade slot, the first blade, the second blade, and any combinations thereof.

9. The separable clasp connector of claim 8, wherein the first and second blades further comprise a chamfer at a leading edge to assist in resiliently deforming the first and second blade slots, respectively.

10. The separable clasp connector of claim 9, wherein the first and/or second blade further comprises a relief that can allow the first and/or second blades to resiliently deform when in the first and second blade slots, respectively.

11. The separable clasp connector of claim 1, wherein the first and second blades, the first and second blade slots, the first and second cam slots, and the first and second pins are configured so that the first and second parts can only be moved to the locked position in a single direction and can only be moved to the unlocked position opposite to the single direction.

* * * * *